US005364544A

United States Patent [19]

Otake et al.

[11] Patent Number: 5,364,544

[45] Date of Patent: Nov. 15, 1994

[54] GREASE FOR A SLIDE CONTACT

[75] Inventors: Sugako Otake; Takeshi Kojima; Michio Aoki, all of Aichi; Eigo Mukasa, Fujisawa; Kikuo Hosaki, Tokyo, all of Japan

[73] Assignee: Kabushiki Kaisha Tokai Rika Denki Seisakusho, Aichi, Japan

[21] Appl. No.: 29,962

[22] Filed: Mar. 9, 1993

Related U.S. Application Data

[63] Continuation of Ser. No. 753,374, Aug. 30, 1991, abandoned.

[30] Foreign Application Priority Data

Aug. 31, 1990 [JP] Japan ..... 2-232201

[51] Int. Cl.[5] ..... C10M 169/06; C10M 117/02; C10M 125/30

[52] U.S. Cl. ..... 252/28; 252/42.1; 252/21; 252/56 S

[58] Field of Search ..... 252/21, 28, 42.1, 56 S, 252/33.6; 585/16, 18

[56] References Cited

U.S. PATENT DOCUMENTS 4,406,800 9/1983 Christain ..... 252/21
4,432,771 2/1984 Sawyer, Jr. ..... 44/280
4,749,502 6/1988 Alexander et al. ..... 252/56 S
4,840,739 6/1989 Mori et al. ..... 252/42.1
4,859,352 8/1989 Waynick ..... 252/56 S
4,879,054 11/1989 Waynick ..... 252/56 S
4,956,122 9/1990 Watts et al. ..... 252/56 S
5,049,291 9/1991 Miyaji et al. ..... 252/56 S

*Primary Examiner*—Margaret B. Medley
*Attorney, Agent, or Firm*—Birch, Stewart, Kolasch & Birch

[57] ABSTRACT

The present invention provides a grease for a slide contact which comprises 100 parts by weight of a synthetic base oil which contains synthetic poly-α-olefin oil mixture as a main ingredient consisting of synthetic poly-α-olefin oil having a low viscosity of from 8 to 30 cSt (40° C.) and synthetic poly-α-olefin oil having a high viscosity of 470 cSt (40 ° C.), 0.1–10 parts by weight of fine particulate clay mineral having micropores and/or fine particulate clay mineral structure having monolayers capable of intercalating water or anions, 5–25 parts by weight of thickener consisting of 12-hydroxy lithium stearate and lithium stearate in a weight ratio of from 20:1 to 5: 1, and 0.1–2.0 parts by weight of a phenolic primary antioxidant. The grease according to the present invention is particularly suitable as a grease for a slide contact of the sliding switch of vehicles such as an automobile.

3 Claims, 7 Drawing Sheets

GREASE FOR A SLIDE CONTACT

This application is a continuation of application Ser. No. 07/753,374 filed on Aug. 30, 1991, now abandoned.

FIELD OF THE INVENTION

This invention relates to a grease for a slide contact which is used for a sliding switch and the like.

BACKGROUND OF THE INVENTION

A grease for a slide contact has been used for a sliding switch and the like of a vehicle such as an automobiles and the like. The following properties are required of the grease in particular:

(i) It does not exert a harmful influence upon slide parts made of resins such as ABS, POM and the like.

(ii) It is hard to deteriorate under arc heat generated at the time of switching the load-break.

(iii) It does not change in quality at temperatures used for soldering a lead wire in a process for producing the switch.

(iv) It has a pour point of less than −45° C. and can be used at low temperatures.

However, there is no grease for the slide contact having all the aforesaid properties among the former greases which are prepared by blending various additives such as a thickener (e.g. soap such as lithium stearate, 12-hydroxy lithium stearate and the like), an anticorrosive, an antioxidant and the like with a mineral oil or a synthetic oil as a base oil.

For example, in the case of the grease which comprises lithium stearate as a thickener, said lithium salt hardens to a varnish like solid state after being heated to a soldering temperature higher than the dropping point of the grease and forms a hard, insulating film on the contact surfaces to which the grease is applied thus exerting a harmful influence upon the electric contact. In the case of the grease which comprises 12-hydroxy lithium stearate as a thickener, a carbonized product of the grease formed by arc heating brings about an insulating deterioration of the switch, although the insulating film is not formed at the soldering temperature.

Furthermore, in the case of the grease which comprises a clay mineral containing hydrated magnesium silicate, such as sepiolite and the like, as an anticorrosive, the grease does not satisfy all of the aforementioned requirements, although an excellent rust-resisting effect can be obtained (Japanese Patent Opening No. 115997/1986).

OBJECT OF THE INVENTION

The present invention has been made in order to provide a grease for a slide contact which satisfies all the aforesaid requirements (i), (ii), (iii), and (iv) of the grease.

SUMMARY OF THE INVENTION

The present invention provides a grease for a slide contact which comprises 100 parts by weight of a synthetic base oil which contains synthetic poly-α-olefin synthetic oil mixture as a main ingredient, consisting of synthetic poly-α-olefin oil having a low viscosity of from 8 to 30 cSt (40° C.) and synthetic poly-α-olefin oil having a high viscosity of from more than 30 to 470 cSt (40° C.), 0.1–10 parts by weight of fine particulate clay mineral having micropores and/or fine particulate clay mineral structure having monolayers capable of intercalating water or anions, 5 –25 parts by weight of thickener consisting of 12-hydroxy lithium stearate and lithium stearate in a weight ratio of from 20:1 to 5:1, and 0.1–2.0 parts by weight of a phenolic primary antioxidant.

DETAILED DESCRIPTION OF THE INVENTION

Figure 1:
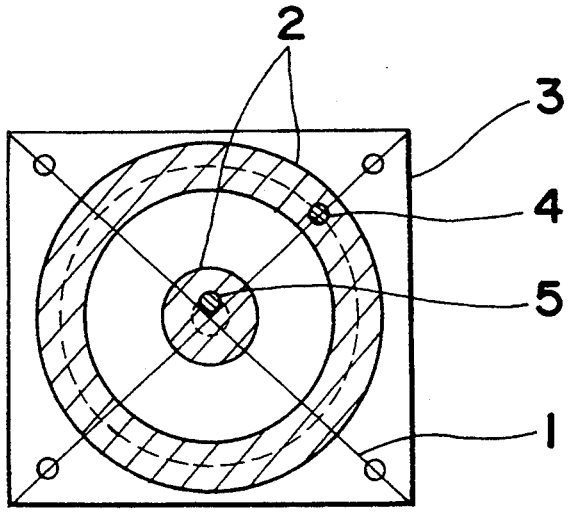
FIG. 1 is a plan of the test sample used in the measurement of the sliding abrasion property of ABS resin.

The base oil of the grease according to the present invention is a synthetic oil which contains the synthetic poly-α-olefin oil whose viscosity is 8–30 cSt (40° C.) as a main ingredient. The contents of the synthetic poly-α-olefin oil are ususally at least about 80 percent by weight which bring about sufficient lubricity at a pour point of −50° C., and guarantee a compatibility of the grease with almost all of the resins, including ABS resin.

As the other ingredients of the base oil, synthetic poly-α-olefin synthetic oil whose viscosity is 470 cSt (40° C.), synthetic hydrocarbon oils which do not exert harmful influence upon the resins such as synthetic diphenyl ether oils having branched hydrocarbon groups, and the like are exemplified.

By blending 0.1–2.0 percent by weight of a synthetic fluorine-containing oil with the base oil, wettability of the grease to the air gaps formed between the resinous insulator and the fixed contact of the sliding switch can be decreased and an insulating deterioration of the switch caused by penetration of the grease into the air gaps can be retarded.

As the aforementioned particular particulate having micropores and/or monolayers capable of intercalating water or anions, Sepiolite, organic bentonite, montmorillonite, synthetic flourite-mica and the like are exemplified. Sepiolite is an example of the particulate having micropores. The sizes of the micropores are 5–100 Å, which correspond to a molecular size scale. The organic bentonite, montmorillonite, synthetic fluorite-mica and the like are examples of a particulate having an includable monolayer. The aforementioned micropores and includable monolayer have an adsorptive property for cations or an interchange-ability for anions. The desirable sizes of the particular particulates are very small (under 10μ is best).

The aforementioned particular particulates are homogeneously by dispersed in the grease, and adsorb soot (CO particulate), Cu plasma, fine particles of Cu oxide, and the like which are the products formed by the arc generated at the time of switching the contact. In the case of the usual grease coated switch, the aforementioned materials formed by the arc concentrate on surface of the neighborhood of the part where the arc is generated. But in the case of the switch coated with the grease of the present invention, according to the adsorption function of the fine particulate, insulating deterioration of the sliding switch caused by accumulation of the soot, fine particles of Cu oxide and the like in the neighborhood of the parts where the arc is generated by repetitive use of the sliding switch, particularly in the air gaps, can be retarded.

The blending amounts of the fine particulate are 0.1–10 parts by weight, preferably 1–5 parts by weight, per 100 parts by weight of the base oil. When the blending amounts of the particular particulates are less than 0.1 part by weight, the aforesaid effect cannot be obtained. If the blending amounts of the particular particulates are more than 10 parts by weight, the viscosity of the grease is decreased and the particular particulates bring about an inorganic residue which is not desirable for the electric contact.

As the thickener of the grease according to the present invention, 12-hydroxy lithium stearate and lithium stearate are used in the weight ratio of from 20:1 to 5: 1. By using 12-hydroxy lithium stearate within said limits of blending, a greasy state can be maintained without being hardened after cooling even if the grease is melted by heating it to temperatures higher than the dropping point (ca. 200° C.) of the grease. When the blending amounts of lithium 12-hydroxy stearate are too high, the aforementioned harmful effects caused by the single use thereof as a thickener we actualized.

Lithium stearate is blended mainly in order to increase the solubility of the thickener in the base oil. When the blending amounts of lithium stearate are too high, the aforesaid harmful effects caused by the single use thereof as a thickener we actualized. Therefore, the blending amounts of lithium stearate should be restricted within the aforementioned limits of blending.

The blending amounts of the above thickener are 5–25 parts by weight, preferably 5–20 parts by weight per 100 parts by weight of the base oil. When the amounts of the thickener are less than 5 parts by weight, the viscosity of the grease is decreased, the oil-separating property of the grease is increased, and antifriction of the sliding parts to which the grease is applied becomes worse. If the amounts of the thickener are more than 25 parts by weight, the smoothness, application property and lubricity of the grease are decreased.

A phenolic primary antioxidant, which is a heat-resistant antioxidant, is blended to the grease according to the present invention because the grease for slide contact is heated to the temperature of more than ca. 180°–200° C. for a short time in the soldering process of lead wire and the like.

As the phenolic primary antioxidant, tetrakis [methylene-3-(3,5-di-t-butyl-4-hydroxyphenyl) propionate] methane, 1,3,5-tris (4-t-butyl-3-hydroxy-2,6-dimethyl butyl) isocyanurate, 3,9-bis[2-(3-(3-t-butyl-4-hydroxy-5-methylphenol) propioxy) -1,1-dimethylethyl]-2,4,8,10-tetraoxapyro (5,5) undecane and the like are exemplified.

The blending amounts of the phenolic primary antioxidant are 0.1–2 parts by weight, preferably 0.2–2 parts by weight per 100 parts by weight of the base oil. When the amounts of the antioxidant are less than 0.1 part by weight, sufficient antioxidative effect cannot be obtained because the antioxidant sublimates at high temperature. It is useless to blend more than 2 parts by weight of the antioxidant.

In addition to the aforementioned ingredients, conventional additives such as metal activates (e.g. benzotriazole and derivatives thereof) and the like may, if necessary, be blended to the slide contact grease according the the present invention.

The present invention is illustrated by the following examples.

EXAMPLES 1–5 AND COMPARATIVE EXAMPLES 1–3

According to the blending prescriptions shown in Table 1, the greases 1–5 (Examples 1–5) and the greases 1'–3' (Comparative Examples 1–3) were prepared by the conventional method. Properties of these greases are also shown in Table 1.

The resin compatibility, thermal resistance, are resistance and low-temperature resistance of these greases were measured by the method described hereinafter. The results of the measurements are shown in Table 2.

(1) RESIN COMPATIBILITY

Stress—Crack Test

Grease samples were applied on the test pieces made of ABS resin ("E-1500" which is commercially available from Mitsubishi Gas Kagaku Inc.) or POM resin ("TENACK" which is commercially available from Asahikasei Inc.). Maximum bending strain (δ) of 1 mm, 2 mm or 3 mm was put upon the applied test pieces according to ASTM-D638 and an examination for the presence of a crack was made after three hours at 75° C. The same test was carried out on the test piece to which no grease is applied as a blank test.

Antiabrasion of ABS Resin

The flat board (3) (3 mm×70 mm×70 mm) made of ABS resin (E-1500) was molded. The marking (1) which is 60μ wide and 30μ deep was scratched diagonally on the surface of the molded flat board as shown in FIG. 1. A movable test sample was prepared by applying the grease sample (2) on the parts of the molded flat board shown by an oblique line in FIG. 1, the applied amounts of the grease sample being 10 mg/cm$^2$. The molded plate made of E-1500 (5ϕ) was employed as a fixed test sample. The movable test sample was installed to the rotator fixed on the motor shown in FIG. 2 and the load of 200 g was applied on the fixed molded plate made of ABS resin. A sliding test of 50,000 times was carried out by rotating the motor at a switching rate of 5 times/min, and the worn conditions of the test samples were examined.

Figure 2:
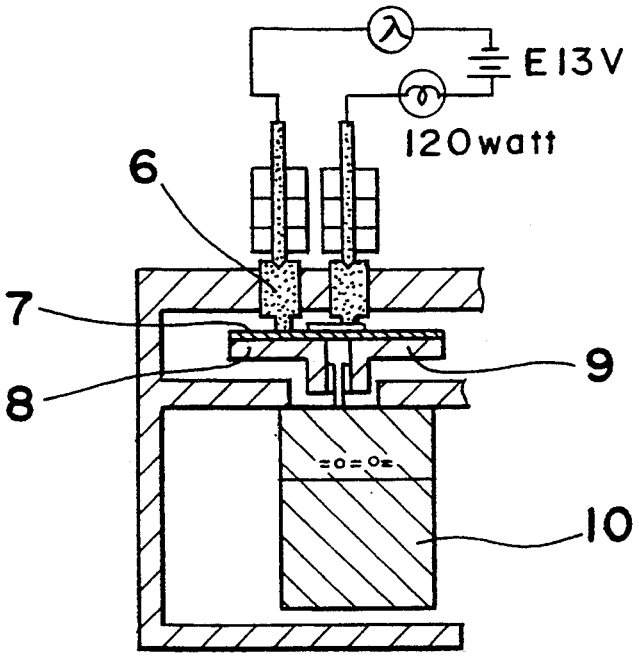
FIG. 2 is a schematic cross section of the apparatus used in the simulation test for repetitive durability of sliding switch.

In FIG. 1, (4) and (5) indicate the fixed test samples which are 5ϕ cylindrical plates to which a load of 200 g is applied. In FIG. 2, (6) indicates the fixed members made of ABS resin and the supporting stands, (7) and (8) indicate the movable test samples, (9) is the rotator and (10) is the motor.

(2) THERMAL RESISTANCE

The sample grease was applied (12 mg/cm$^2$) on the buffed copper plate whose thickness is 0.6 mm. Soldering was carried out at the place that is 20 mm away from the applied part by means of a solder (Sn 60). A soldering iron was in contact with the copper plate for three minutes after the temperature at the part coated with the grease became 200° C. Based on the results of a preliminary test by means of a copper plate to which no grease is applied, the voltage applied to the soldering iron was adjusted in such a way that the temperature at the part of the copper plate to be measured is maintained at 200° C. Hardening (Varnishization) of the grease, and sublimation of the antioxidant and metal activator, were estimated by a preliminary investigation with the eye and IR chart wherein it is investigated whether the grease is deteriorated by the heating. If the grease hardens, an electric contact resistance of the copper plate coated with the grease is increased. Corrosion of the copper plate is induced when the metal activator has disappeared. Accordingly, the contact resistance of the test sample was measured after the test sample which was subjected to the thermal resistance test at 200° C. was left in the thermostatic chamber (60° C.; 95% RH ) for 98 hours.

Figure 3:
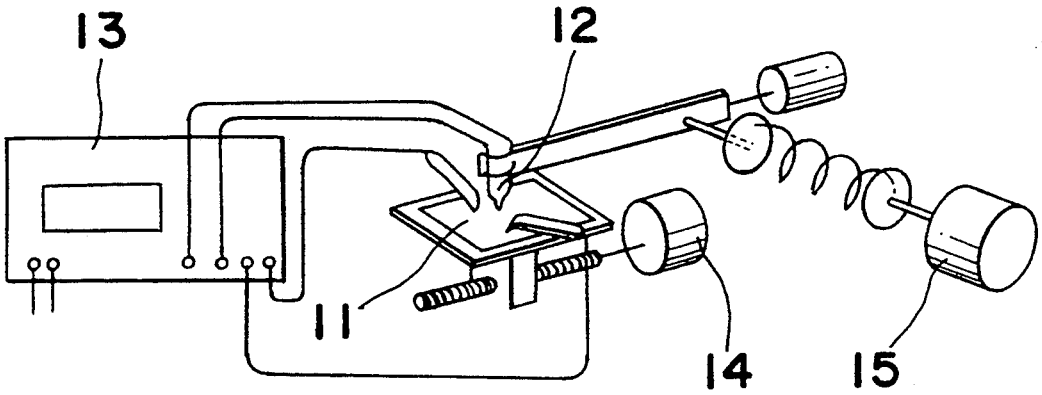
FIG. 3 is a schematic constructional view of the measuring apparatus for electric contact resistance.

The contact resistance was measured by means of the simulator for electric contact (FIG. 3). The measurement was carried out by changing a contact pressure slidingly between 0 g and 50 g under the electric current of 10 mA.

In FIG. 3, (11), (12), and (13) indicate a surface of the sample to be measured, a contact made of gold and a resistance meter respectively and (14) and (15) show a synchronous motor.

(3) ARC RESISTANCE

A Test Sample

Figure 4:
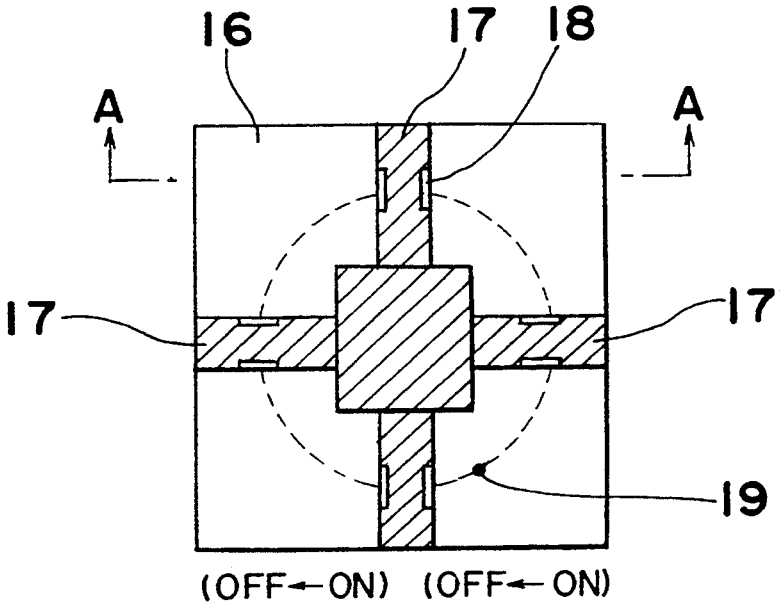
FIG. 4 is a schematic plan of the sliding switch used for the test.
Figure 5:
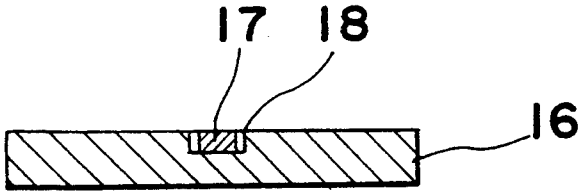
FIG. 5 is a cross section along A—A line in FIG. 4.

A test sample of the sliding switch which is similar to the practical sliding switch was prepared, and is shown in FIG. 4 and FIG. 5. FIG. 4 is schematic plan of the test sample. FIG. 5 is a cross-section of the test sample along A—A line in FIG. 4. A stator was constructed by burying a fixed contact made of copper (17) in an insulator made of nylon 66 (16) with which an inorganic filler is blended and by making air gap (18) in the switching parts of the contact. A sample grease was applied to a sliding surface of a rotatable contact made of copper (19).

An Apparatus for the Test

The test sample prepared as mentioned above was mounted on the rotor of the motor (10) shown in FIG. 2. The predetermined load was switched by applying the load as shown in FIG. 2 and by rotating the motor (applied voltage: DC 13 V, load: 120 W lamp, switching rate of the load: 5 times per minute). The switching test was carried out 50,000 times. In the region wherein the air gap (18) is formed, the insulation resistance of the insulator was measured at a site which is 3 mm away from the edge of the fixed contact (17). A voltage drop between the contacts at the time of connecting the load was measured at intervals of 10,000 times.

(4) LOW-TEMPERATURE RESISTANCE

Starting and rotational torques at −40° C. were measured according to JIS-K-2220 5.14. Pour point of the sample grease was also measured.

TABLE 1

| Ingredients or properties of the greases | Greases | Examples 1 | 2 | 3 | 4 | 5 | Comparative Examples 1′ | 2′ | 3′ |
|---|---|---|---|---|---|---|---|---|---|
| Ingredients (parts by weight) | Synthetic poly-α-olefin oil (50 cSt/40° C.) | 0 | 0 | 0 | 0 | 0 | 81.0 | 0 | 0 |
| | Synthetic poly-α-olefin oil (30 cSt/40° C.) | 69.2 | 69.2 | 68.7 | 66.2 | 66.2 | 0 | 69.9 | 57.5 |
| | Synthetic poly-α-olefin oil (470 cSt/40° C.) | 20.3 | 20.3 | 20.3 | 19.3 | 19.3 | 0 | 20.6 | 16.5 |
| | Trifluorinated ethylene chloride | 0 | 0 | 0.5 | 0 | 0 | 0 | 0 | 0 |
| | Diphenyl ethereal synthetic oil | 0 | 0 | 0 | 0 | 0 | 0 | 0 | 16.5 |
| | Lithium stearate | 0.7 | 0.7 | 0.7 | 0.7 | 0.7 | 16.0 | 0.7 | 0.7 |
| | 12-Hydroxy lithium stearate | 6.0 | 6.0 | 6.0 | 6.0 | 6.0 | 0 | 6.0 | 6.0 |
| | α-olefin polymer | 2.0 | 2.0 | 2.0 | 2.0 | 2.0 | 0 | 2.0 | 2.0 |
| | Organic bentonite 1) | 1.0 | 0 | 0 | 0 | 0 | 0 | 0 | 0 |
| | Sepiolite 2) | 0 | 1.0 | 1.0 | 5.0 | 0 | 0 | 0 | 0 |
| | Synthetic mica 3) | 0 | 0 | 0 | 0 | 5.0 | 0 | 0 | 0 |
| | Irganox 1010 4) | 0.2 | 0.2 | 0.2 | 0.2 | 0.2 | 0 | 0.2 | 0.2 |
| | 2,6-Di-t-butyl-4-methyl phenol | 0 | 0 | 0 | 0 | 0 | 1.0 | 0 | 0 |
| | Benzotriazole | 0.6 | 0.6 | 0.6 | 0.6 | 0.6 | 0 | 0.6 | 0.6 |
| Properties | consistency (WP) | 321 | 318 | 330 | 311 | 312 | 278 | 321 | 311 |
| | Dropping point (°C.) | 190 | 190 | 190 | 190 | 190 | 208 | 190 | 190 |
| | Vaporized amounts (%) [99° C. 22 h] | 0.30 | 0.30 | 0.30 | 0.20 | 0.20 | 0.65 | 0.20 | 0.30 |
| | Degree of oil separation (%) [100° C. 24 h] | 4.3 | 4.3 | 4.8 | 4.0 | 4.0 | 6.0 | 4.3 | 4.5 |

1) "Organite" which is commercially available from Nihon Yuukinendo Incorporated.
2) "Pulverized sepiolite from China" which is commercially available from Oumi Kogyo Incorporated.
3) "4C-TS" which is commercially available from Toppy Kogyo Incorporated.
4) Tetrakis [methylene-3(3,5-di-t-butyl-4-hydroxyphenyl)propionate] methan which is commercially available from Ciba Geigy Incorporated.

TABLE 2

Figure 6:
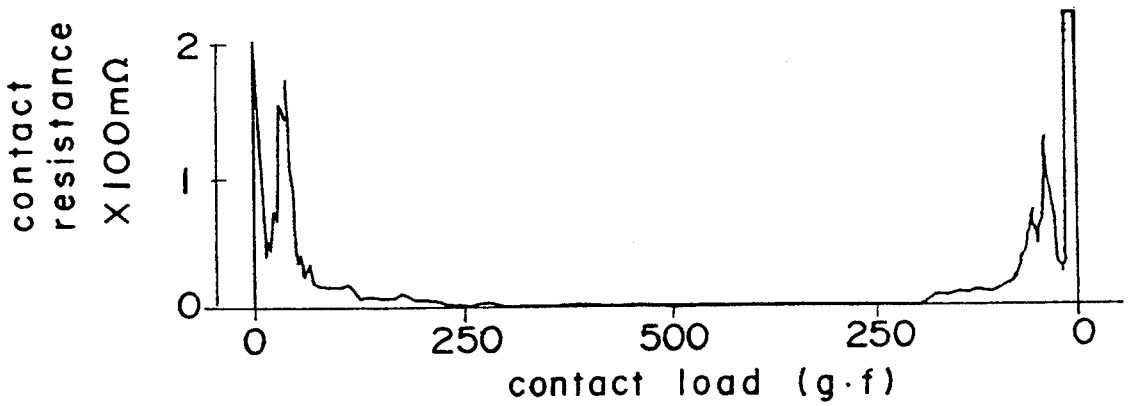
FIG. 6–FIG. 9 are the charts which show the relation between contact load and contact resistance measured by means of the simulator shown in FIG. 3 with the greases 2, 4, 1' and 2', coated on contacts respectively, said greases being prepared in the examples and comparative examples mentioned below.
Figure 7:
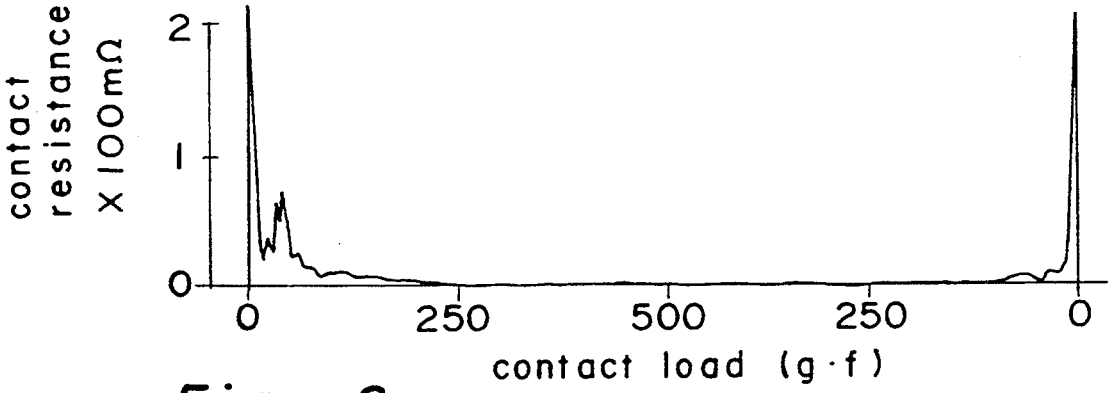
Figure 8:
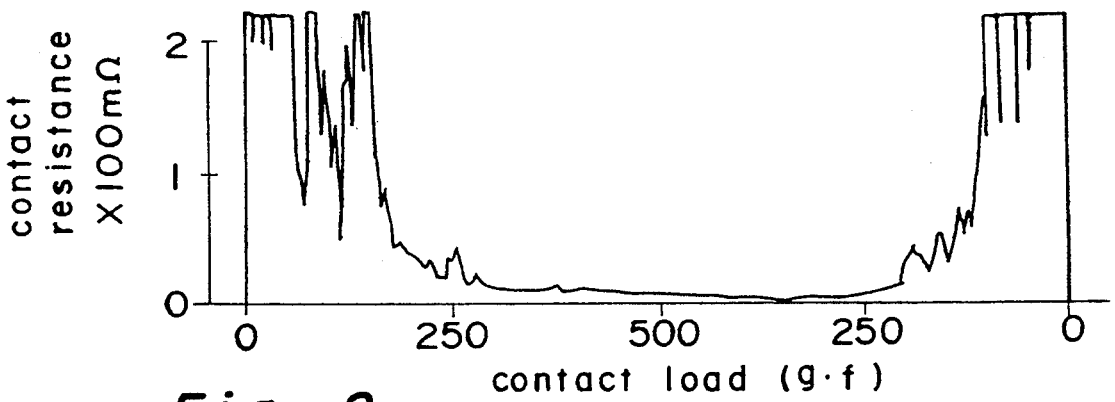
Figure 9:
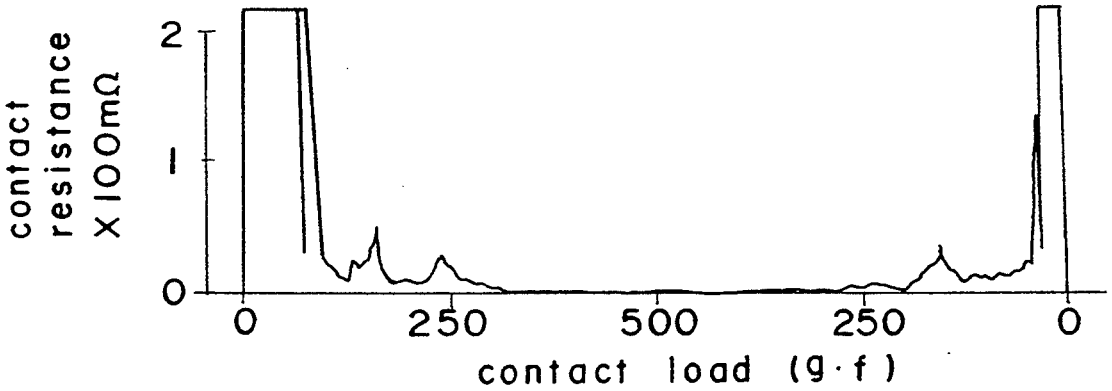
Figure 10:
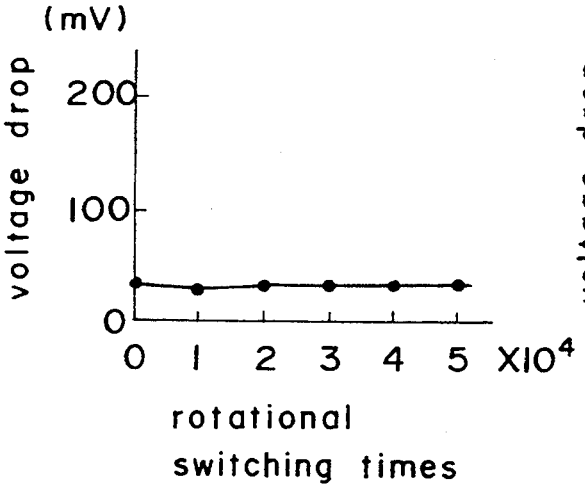
FIG. 10–FIG. 17 are the graphs which show the relation between rotational switching times and contact voltage drop with respect to the greases 1, 2, 3, 4, 5, 1', 2', and 3' respectively.
Figure 11:
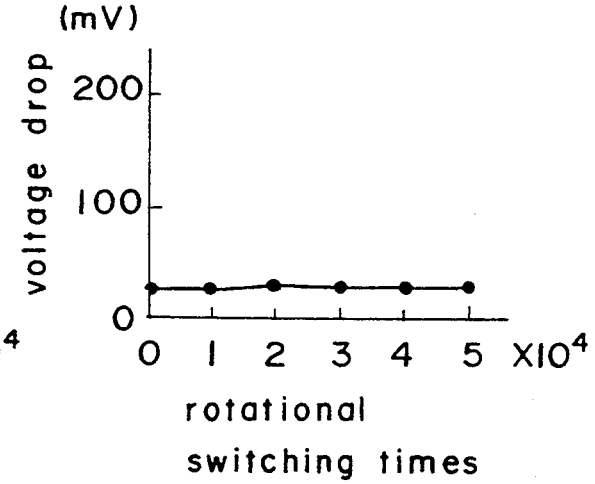
Figure 12:
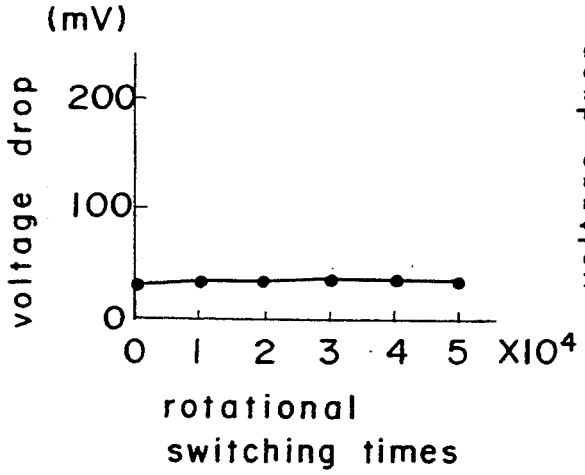
Figure 13:
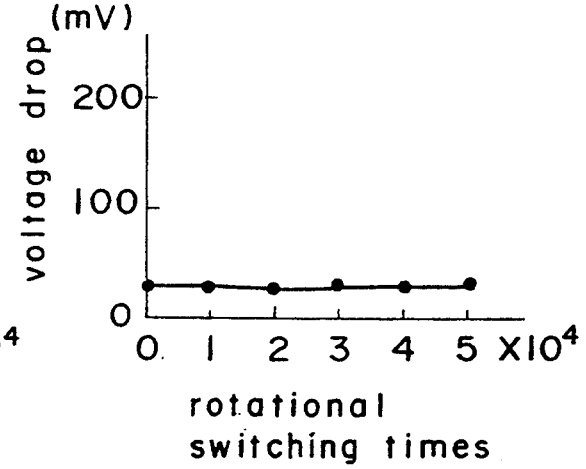
Figure 14:
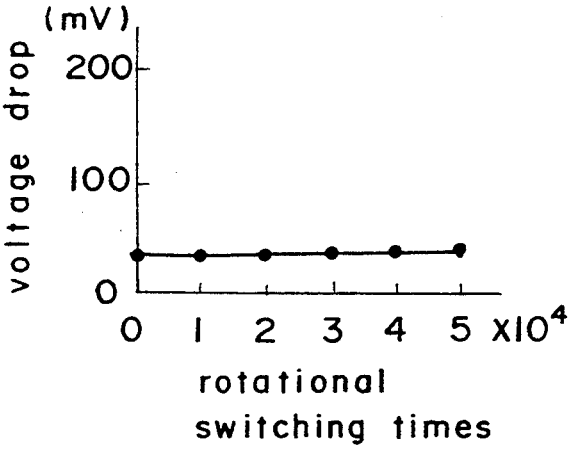
Figure 15:
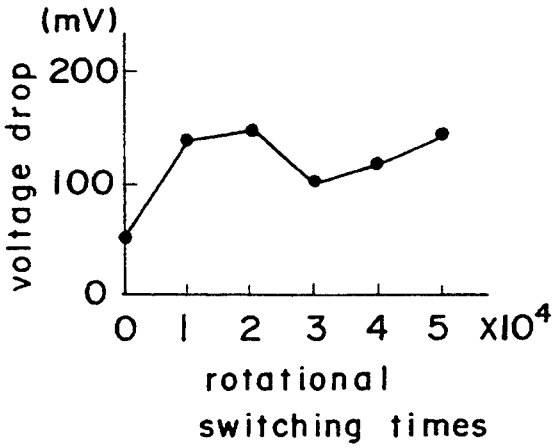
Figure 17:
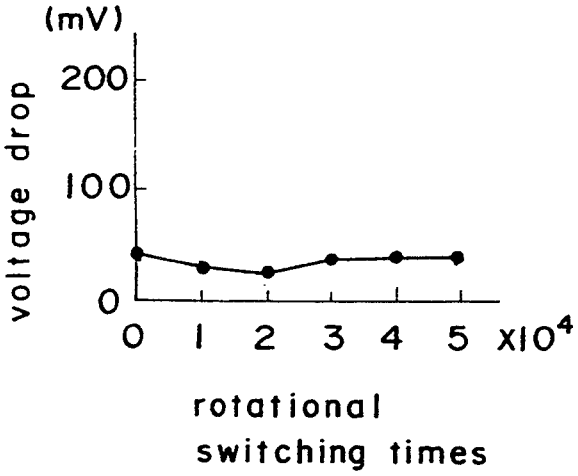
Figure 16:
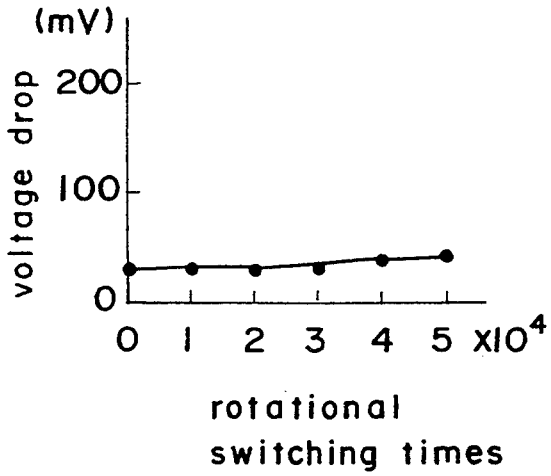
Figure 18:
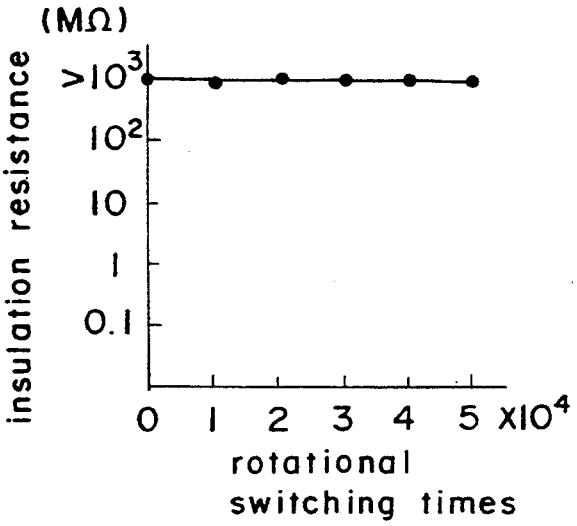
FIG. 18–FIG. 25 are the graphs which show the relation between rotational switching times and insulation resistance with respect to the greases 1, 2, 3, 4, 5, 1', 2', and 3' respectively.
Figure 19:
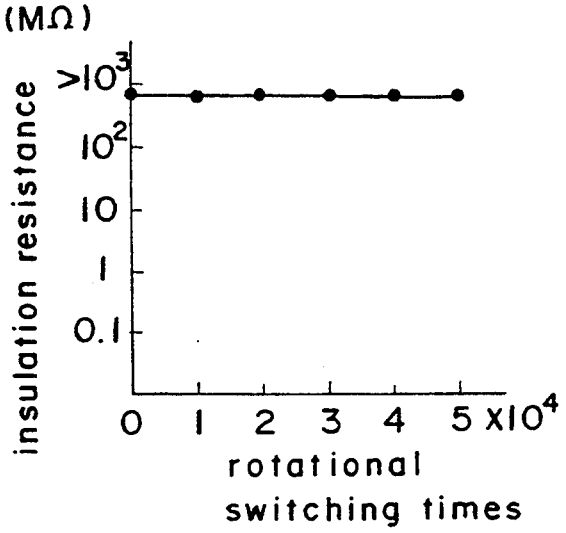
Figure 20:
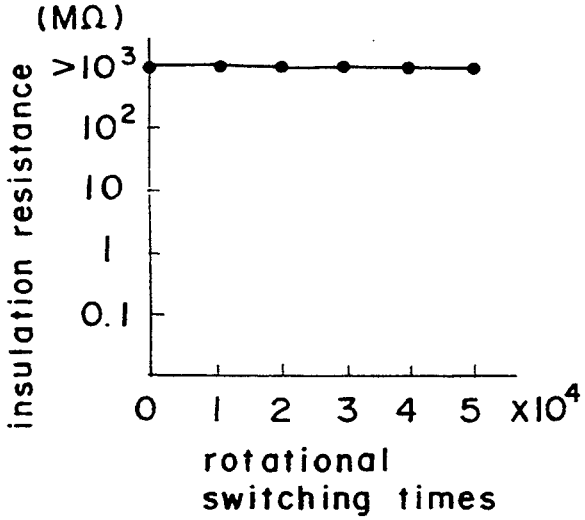
Figure 21:
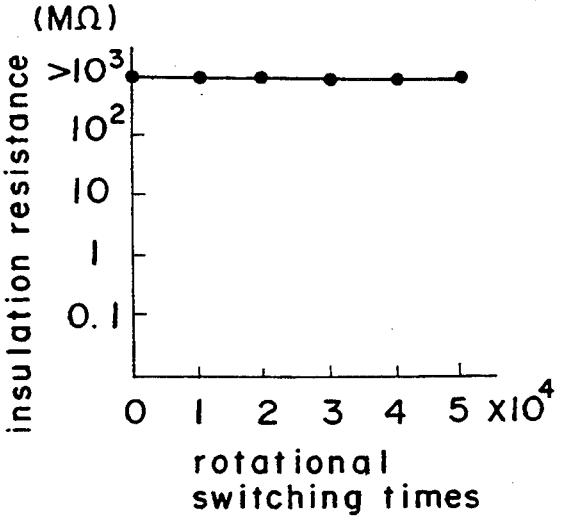
Figure 22:
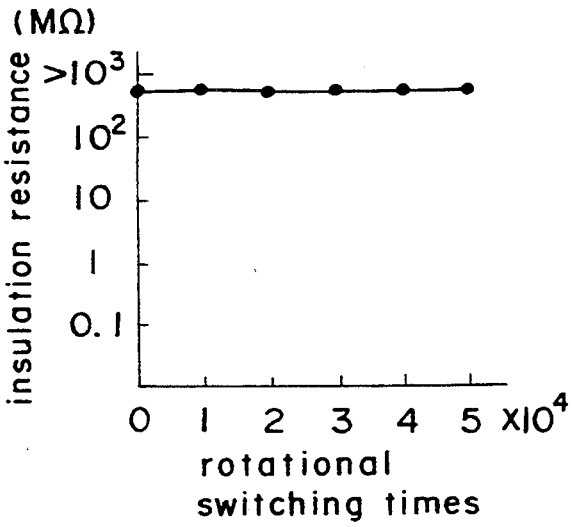
Figure 23:
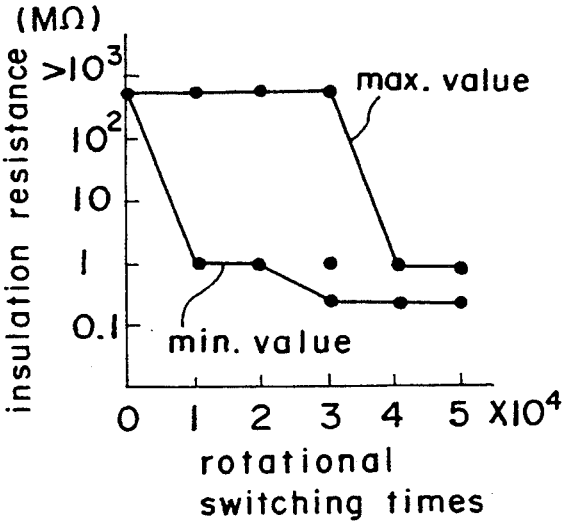
Figure 24:
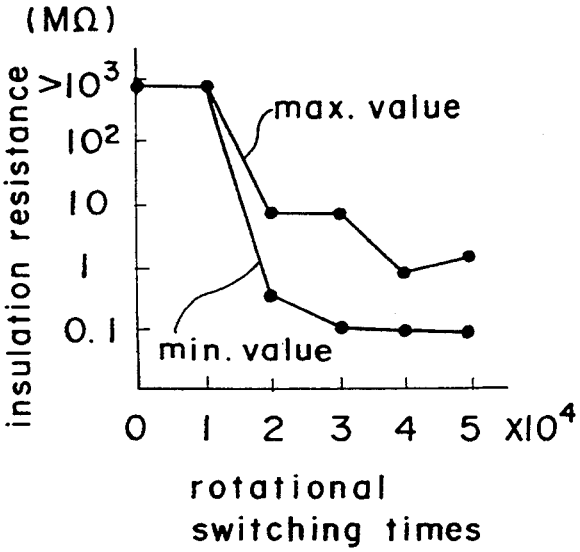
Figure 25:
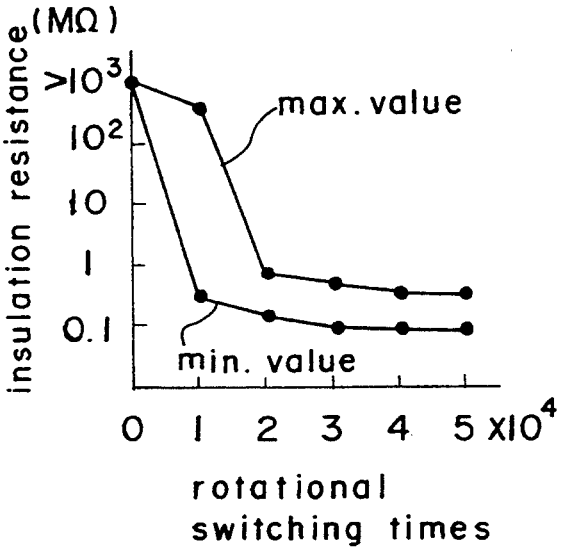

| Properties of the greases | Greases | Examples 1 | 2 | 3 | 4 | 5 | Comparative Examples 1' | 2' | 3' |
|---|---|---|---|---|---|---|---|---|---|
| Resin compatibility | Stress-crack test | No influence (Critical stress was not decreased.) | | | | | | | 1) |
| | Antiabrasion of ABS resin | Abrasion depth was less than 20μ. | | | | | | | |
| Thermal resistance | Changes of the properties | No hardening; No corrosion of copper | | | | | 2) | 3) | 4) |
| | Contact resistance | — | FIG. 6 | — | FIG. 7 | — | FIG. 8 | FIG. 9 | — |
| Arc resistance | Voltage drop | FIG. 10 | FIG. 11 | FIG. 12 | FIG. 13 | FIG. 14 | FIG. 15 | FIG. 16 | FIG. 17 |
| | Insulation resistance | FIG. 18 | FIG. 19 | FIG. 20 | FIG. 21 | FIG. 22 | FIG. 22 | FIG. 24 | FIG. 25 |
| Low-temperature resistance | Starting torque at - 40° C. (gfcm) | 1500 | 1495 | 1560 | 1400 | 1400 | 4000 | 1270 | 2300 |
| | Rotational torque at - 40° C. | 520 | 550 | 580 | 650 | 650 | 1400 | 560 | 975 |
| | Pour point (°C.) | | | −50 | | | −40 | −50 | |

1) The grease influenced ABS resin.
2) The grease was hardened and the contact resistance was high.
3) The grease was hardened to some extent and the contact resistance was relatively high.
4) The grease was not hardened and the copper plate was not corroded.

The grease according to the present invention is suitable to a grease for a slide contact of the sliding switch of vehicles such as an automobile and the like in particular because it has the aforementioned important properties which are required of the grease for the slide contact.

What is claimed is:

1. A grease for a slide contact which comprises:

(a) 100 parts by weight of a synthetic base oil, comprising a low viscosity synthetic poly-α-olefin oil having a viscosity of from 8 to 30 cSt (40° C.) as a main ingredient and a high viscosity synthetic poly-α-olefin oil having a viscosity of 470 cSt (40° C.);

(b) 0.1–10 parts by weight of a fine clay particulate having micropores or a monolayer which intercalates water or anions;

(c) 5–25 parts by weight of a thickener consisting of lithium 12-hydroxy stearate and lithium stearate in a weight ratio of from 20:1 to 5:1; and (d) 0.1–2.0 parts by weight of a phenolic primary antioxidant.

2. The grease according to claim 1, wherein said synthetic base oil further comprises 0.1–2 percent by weight of a fluorinated synthetic base oil.

3. The grease according to claim 1, wherein said fine clay particulate is at least one clay mineral selected from the group consisting of organic bentonite, sepiolite, montmorillonite and synthetic fluorite mica.

* * * * *